US005205267A

United States Patent [19]

Burdick

[11] Patent Number: 5,205,267

[45] Date of Patent: Apr. 27, 1993

[54] OVERDRAW ASSEMBLY FOR AN ARCHERY BOW

[76] Inventor: Richard Burdick, 8409 Henry Clay Blvd., Clay, N.Y. 13041

[21] Appl. No.: 555,103

[22] Filed: Jul. 20, 1990

[51] Int. Cl.[5] ..... F41B 5/00

[52] U.S. Cl. ..... 124/24.1; 124/44.5; 124/86

[58] Field of Search ..... 124/23.1, 24.1, 25.6, 124/44.5, 86, 88, 90

[56] References Cited

U.S. PATENT DOCUMENTS

| | | | |
|---|---|---|---|
| 2,664,078 | 12/1953 | Irwin | 124/24.1 |
| 2,926,650 | 3/1960 | Irwin | 124/24.1 |
| 4,291,664 | 9/1981 | Nishioka | 124/44.5 |
| 4,385,618 | 5/1983 | Nishioka | 124/44.5 X |
| 4,446,844 | 5/1984 | Nishioka | 124/44.5 |
| 4,478,202 | 10/1984 | Anderson | 124/23.1 |
| 4,829,974 | 5/1989 | Anderson | 124/24.1 |
| 4,917,071 | 4/1990 | Bozek | 124/24.1 X |

*Primary Examiner*—Randolph A. Reese
*Assistant Examiner*—Jeffrey L. Thompson
*Attorney, Agent, or Firm*—Douglas S. Bishop

[57] ABSTRACT

An overdraw assembly for use with an archery bow of the type including a bow having a central bow section and limb sections and a bow string secured at its opposite ends to the free ends of the limb sections. The overdraw assembly includes an elongated track, a bracket secured to the central bow section and mounting the elongated track in a position extending transversely of the central bow section from a location substantially forwardly of the central bow section to a location rearwardly of the central bow section, a base member mounted for sliding movement along the track, a guard member secured to the upper face of the base member and having an upwardly opening U-shaped configuration in cross section to receive the forward end of an arrow to protect the arm of the user as the arrow is projected forwardly, a spring secured to the front end of the track and to the front end of the arrow guard, and an elastic member secured to the rear end of the guard member and to the bow string so that the guard member is pulled rearwardly along the track in response to rearward movement of the bow string with the rearward movement of the guard member being loaded and resisted by extension of the spring so that, as the bow string is thereafter released, the arrow is projected forwardly and the guard member moves forwardly along the track under the urging of the extended spring to a forward stop position relative to the track where it is ready to receive another arrow.

36 Claims, 2 Drawing Sheets

OVERDRAW ASSEMBLY FOR AN ARCHERY BOW

FIELD OF THE INVENTION

This invention relates to archery bows and more particularly to an overdraw device for use with an archery bow.

BACKGROUND OF THE INVENTION

Archery bows have been in use for centuries for various purposes including hunting, target shooting and the like. In recent years, various attempts have been made to increase the speed of the arrows by using shorter and lighter arrows but the use of shorter arrows has presented the problem that the forward tip of the arrow is subject to being drawn rearwardly past the hand grip of the bow. In an attempt to overcome this problem, various so-called overdraw devices have been proposed to allow the short arrow to be drawn rearwardly to a point where the forward tip of the arrow is positioned rearwardly of the bow without disengaging the arrow and while still providing positive guidance for the arrow. Whereas these prior art overdraw systems have achieved varying degrees of success and have been adopted to some extent, each of the prior art systems have suffered from one or more disadvantages. Specifically, the prior art systems have either been too expensive or too complicated relative to the overall cost of the total bow assembly; they have not been successful in providing the desired added speed for the shorter arrows; or they have introduced safety factors which endanger the hand or arm of the user.

SUMMARY OF THE INVENTION

This invention is directed to the provision of an improved overdraw assembly and an improved bow assembly employing the improved overdraw assembly.

The invention overdraw assembly is for use with an archery bow assembly of the type including a bow including a central handle section and limb sections and a bow string extending between the free ends of the limb sections. According to one feature of the invention overdraw assembly, the assembly includes a slide, means mounting the slide on the central handle section of the bow for sliding movement along a path generally transverse to the handle section and the bow string and including means to receive the forward end of an arrow with the nock of the arrow engaging the bow string, and means biasing the slide for movement along the slide path. This arrangement allows the slide to move relative to the bow section as the bow string is drawn so as to continue to provide a rest for the forward end of the arrow irrespective of the extent of rearward movement of the bow string.

According to a further feature of the invention, the biasing means compromises resilient means fixed at one end to the mounting means for the slide and connected at its other end to the slide. This arrangement imparts a biasing force to the slide as the slide is drawn rearwardly in response to rearward movement of the bow string and assists the forward movement of the slide upon release of the bow string.

According to a further feature of the invention, the overdraw assembly further includes a flexible member extending from the slide and adapted to be connected to the bow string so as to pull the slide rearwardly as the bow string is pulled rearwardly.

According to a further feature of the invention, the flexible member between the slide and the bow string comprises an elastic member. This arrangement allows relative movement between the bow string and the slide and yet accomplishes the desired rearward movement of the bow string.

According to a further feature of the invention, the slide includes a forward end proximate the bow and a rearward end proximate the bow string and the biasing means comprises a spring fixed at its forward end to the mounting means for the slide and connected at its rearward end to the slide. This arrangement provides a ready and convenient means of loading the slide as it is moved rearwardly along the mounting means.

According to a further feature of the invention, the mounting means for the slide comprises an elongated track adapted to be secured to the central bow section and extending generally transversely of the bow and of the bow string. The slide is mounted for sliding movement along the track, and the spring is secured at one end to the forward end of the track and connected at its other end to the forward end of the slide. This arrangement provides positive guidance for the slide and provides a convenient means of loading the slide as it is moved rearwardly.

According to a further feature of the invention, the slide comprises an assembly including a base member mounted slidably on the track and a guard member secured to the base member and having an upwardly opening U-shaped configuration in cross section. This arrangement allows the arrow to be positioned within the shelter of the U-shaped configuration of the guard member so as to preclude injury to the user as the slide and arrow are moved rearwardly and thereafter released.

According to a further feature of the invention, the arrow receiving means comprises an arrow rest positioned within the U-shaped configuration of the guard member proximate the rear end of the guard member. This arrangement provides a secure and positive rest for the forward end of the arrow while continuing to preclude injury to the user.

According to a further feature of the invention, the elongated track is rigidly secured to the central bow section and extends from a location substantially forwardly of the central bow section to a location rearwardly of the central bow section. This arrangement allows the required amount of rearward movement of the slide to accommodate the rearward movement of the bow string while further providing positive guidance for the slide as it moves forwardly upon release of the bow string.

DETAILED DESCRIPTION OF THE PREFERRED EMBODIMENT

Figure 1:
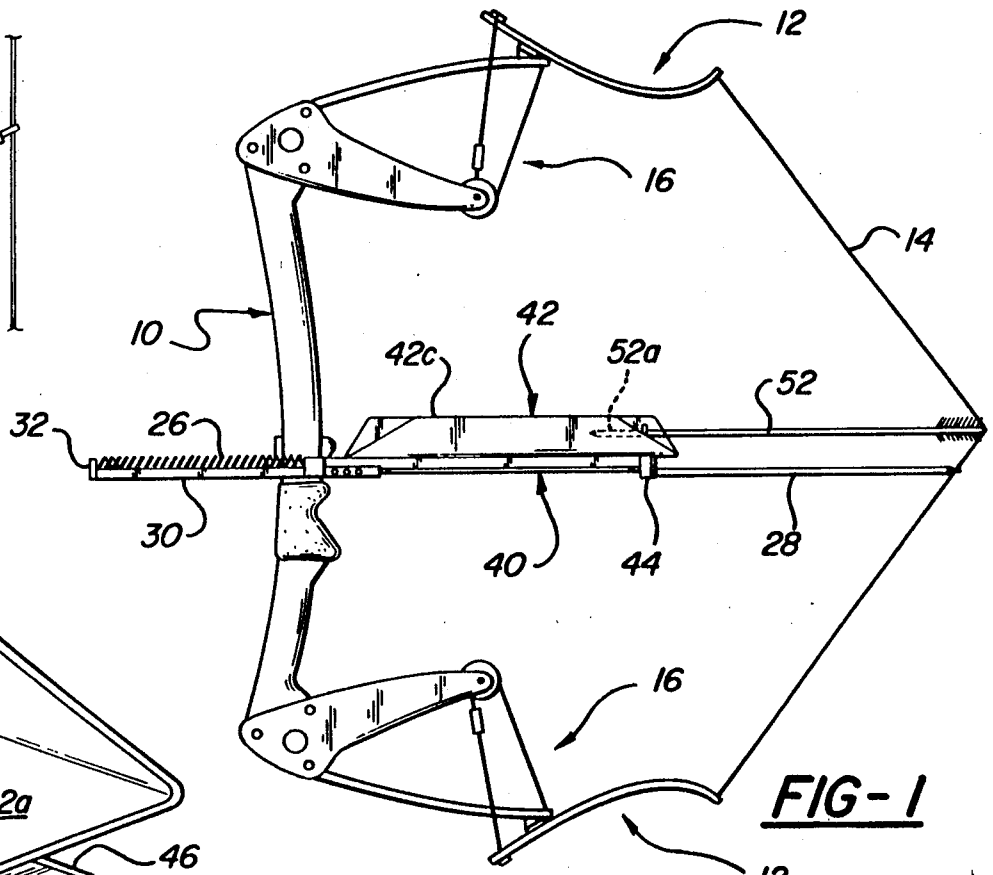
FIG. 1 is a view showing the invention overdraw assembly in a rearwardly disposed configuration.

The archery bow assembly seen in FIG. 1 includes a central handle section 10, limb sections 12, and a bow string 14 secured at its opposite ends to the free ends of the limb sections. Although the archery bow assembly seen in FIG. 1 is of the compound type including compounding pulley assemblies as seen at 16, the invention overdraw assembly is not limited it its application to a compound bow assembly r but rather may be used with any archery bow assembly.

The invention overdraw assembly includes a track assembly 20, a bracket 22 to mount the track assembly 20 on the handle section 10 of the bow, a slide assembly 24 adapted to be slidably mounted on the track assembly 20, a spring 26, and a flexible member 28.

Track assembly 20 includes an elongated track 30, a front plate 32, and a stop pin 34.

Track 30 may be formed as a metallic extrusion and defines an upwardly opening groove 30*a* extending the full length of the track and including undercut groove portions 30*b*.

Front plate 32 is suitably secured to the front end of track 30 as by screws and further carries a spring mounting screw 36 which is adjustable relative to the plate by a nut 38.

Stop pin 34 has a dowel configuration and is arranged to be inserted into a selected one of a series of longitudinally spaced openings 30*c* in the side wall of track 30.

Bracket 22 is formed of a metallic material and is adapted to be secured to central bow section 10 and to mount track 30 rigidly relative to the central bow section in a direction generally transverse to the central bow section with the track extending substantially forwardly from the central bow section as well as rearwardly from the central bow section. Bracket 22 includes a mounting portion 22*a* for suitable securement as by screws to track 30 to rigidly secure the track to the bracket 22 and further includes a generally U-shaped forward bow mounting section 22*b* adapted to embrace the central bow section 10 and be secured thereto as by the use of a suitable screw fastener so as to position the central bow section 10 between bracket portion 22*b* and track 30.

Slide assembly 24 includes a base member 40, an arrow guard 42, a stop block 44, and a stop plate 46.

Base member 40 is preferably formed as a metallic extrusion and has a length somewhat less than the length of track 30. Base member 40 is configured along its lower opposite edges to define tongues 40*a* for respective sliding receipt in groove portions 30*b* of track 30 so as to slidably mount base member 40 for sliding movement in groove 30*a* of track 30.

Arrow guard 42 may have a metallic or plastic construction and has a generally upwardly opening U-shaped configuration in cross section defined by a base portion 42*a*, an inboard wall portion 42*b*, and an outboard wall portion 42*c*. A cutout 42*d* is provided at the rear end of base portion 42*a* and an arrow rest 50 is secured to the inboard wall 42*b* of the arrow guard proximate the rear end of the arrow guard and defines an upwardly opening V notch 50*a* for resting receipt of the forward end 52*a* of an arrow 52. Arrow guard 42 is secured to the upper face 40*b* of base member 40 as by screw bolts and has a length approximating the length of the base member 40. In its mounted position on top of base member 40, the forward end of the arrow guard is spaced slightly rearwardly of the forward end of base member 40 and the rearward end of the arrow guard is spaced slightly rearwardly of the rear end of the base member 40.

Stop block 44 may comprise a metal block and is secured to the rear end 40*c* of base member 40 as by screw bolts with the lower portion 44*a* of the stop block projecting downwardly below the lower face of base member 40 with a stop cushion 54 of cushioning material adhesively secured to the forward face 44*b* of the stop block at a location below base member 40 and with a further stop cushion 55 of cushioning material, having a size and shape conforming to the size and shape of the rear face 44*c* of the stop block, adhesively secured to the stop block rear face.

Stop plate 46 comprises a rectangular metal block and is secured to the outboard side edge 40*d* of base member 40 proximate the front end of the base member as by screw bolts. The upper portion of base member 40 has a width approximately the width of track 30 so that, with base member 40 received in groove 30*a*, stop plate 46 may extend downwardly to guide slidably along the outboard side edge 30*d* of the track for coaction with stop pin 34 to limit the rearward movement of slide assembly 24 on track 30.

Spring 26 comprises a metallic coil spring and includes a front end mounting portion 26*a* secured to the rear face of front plate 32 by screw 36 and a rear mounting portion 26*b* secured to the front end of base member 40 by a screw 60. In its assembled position, spring 26 is positioned within the forward end of groove 30*a* of track 30.

Flexible member 28 comprises a cord, and more particularly an elastic tubular member including loops 62 and 64 secured to the opposite ends of the elastic tubular member by suitable and known means. The forward end of member 28 is secured to the rear face 44*c* of stop block 44 by a screw 66 passing through loop 62, and the rear end of member 28 is secured to bow string 14 by passing the bow string through loop 64.

Figure 2:
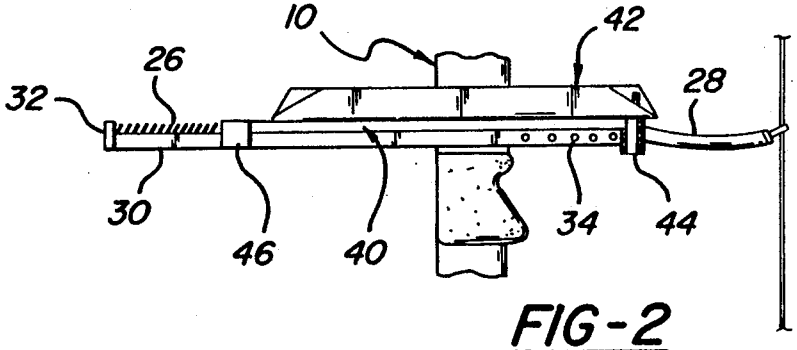
FIG. 2 is a fragmentary view showing the invention overdraw assembly in a forwardly disposed configuration.
Figure 3:
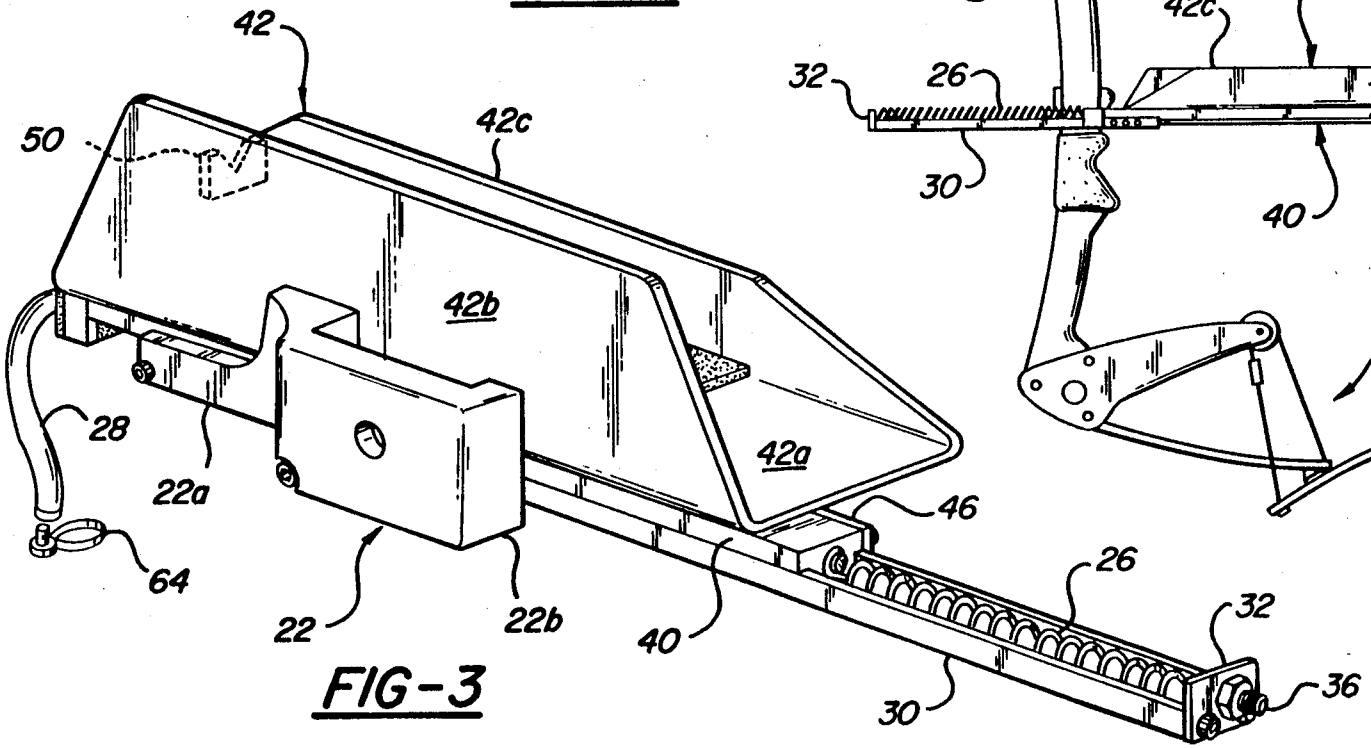
FIG. 3 is a perspective view of the invention overdraw assembly.
Figure 4:
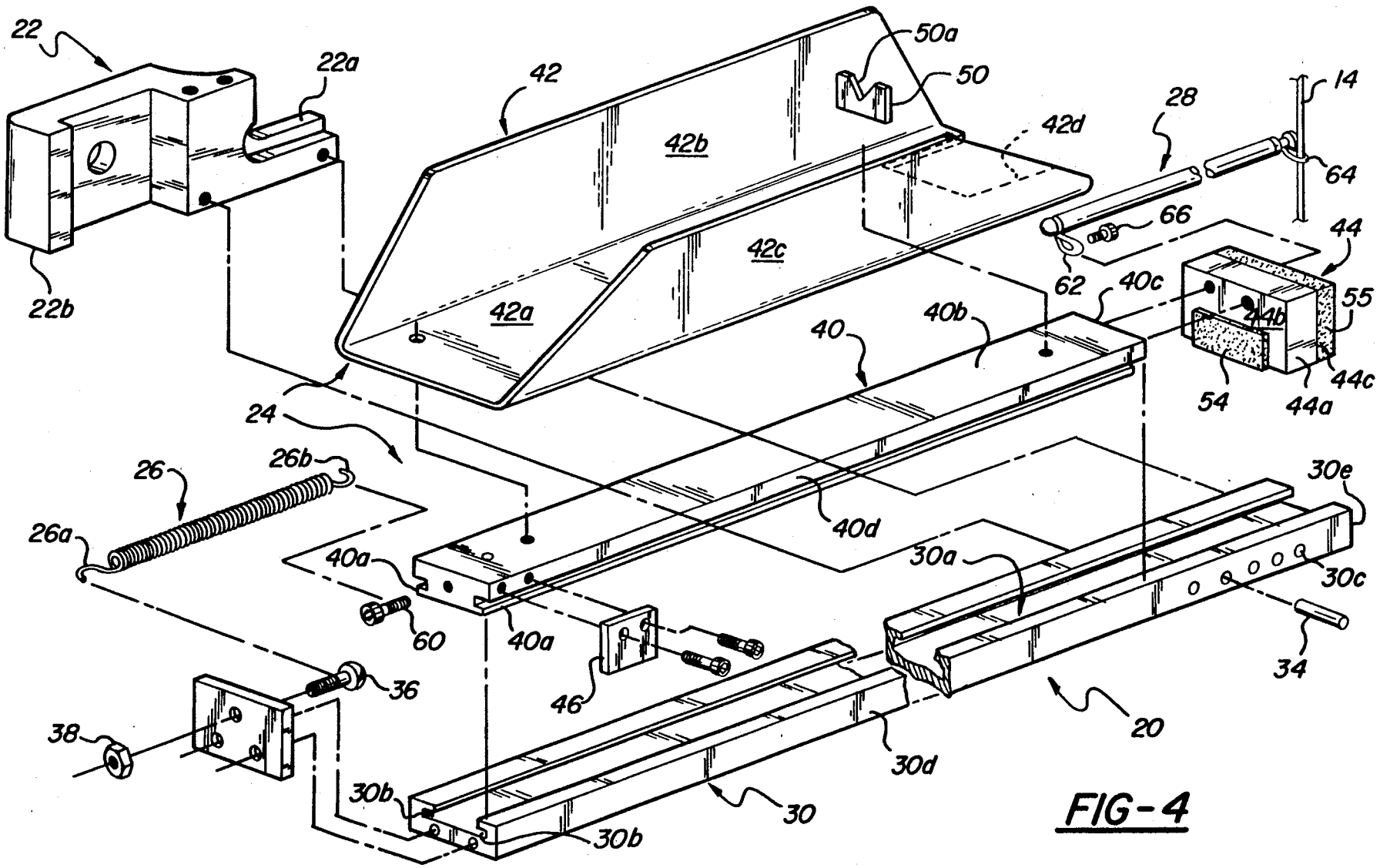
FIG. 4 is an exploded perspective view of the invention overdraw assembly.

The disposition of the invention overdraw assembly in its relaxed condition is seen in FIG. 2 and the disposition of the invention overdraw assembly in its drawn condition is seen in FIG. 1.

In use, as the string 14 is drawn rearwardly by the archer with the nock of the arrow 52 engaged in known manner with bow string 14 and the front end 52*a* of the arrow positioned within arrow guard 42 and supported by arrow rest 50, elastic member 28 serves to pull arrow guard 42 rearwardly along with the rearward movement of the bow string so as to allow the forward end 52*a* of the arrow to move substantially rearwardly of the central bow section 10 without losing support by the arrow rest 50 and with the rearward movement of the arrow guard 42 being resisted and biased by the extension of spring 26. The rearward movement of arrow guard 42 relative to track 30 is adjustably delimited by the engagement of stop plate 46 on base member 40 with stop pin 34.

As the bow string is released from the drawn disposition seen in FIG. 1, the arrow is projected forwardly in rapid fashion by the bow string and the arrow guard 42 moves forwardly under the urging of spring 26 until cushion 54 carried by stop block 44 engages the rear end 30*e* of track 30 to define the limit of forward movement of the arrow guard relative to the track. The overdraw assembly has now returned to the relaxed condition seen in FIG. 2 where it is ready for the receipt of another arrow. Cutout 42*d* in the rear edge of the arrow guard 42 allows bow string 14 to move forwardly to a location where it may contact the rear face of stop cushion 55 without touching the arrow guard 42.

The invention overdraw assembly will be seen to provide an inexpensive and effective means of allowing the use of shorter arrows in association with any type of bow assembly. The invention overdraw assembly is simple and inexpensive in construction, durable and safe in use, and allows an usually large amount of overdraw to be achieved without endangering the archer, without losing engagement with the arrow, and without derogating the positive control at all stages in the retraction and projection process.

Whereas a preferred embodiment of the invention has been illustrated and described in detail, it will be apparent that various changes may be made in the disclosed embodiment without departing from the scope or spirit of the invention.

I claim:

1. An archery bow assembly comprising:

a bow including a central handle section and limb sections;

a bow string extending between the free ends of the limb sections rearwardly of the central handle section;

a slide mounted for sliding movement of said central handle section of said bow along a path generally transverse to said handle section and said bow string and including means to receive the forward end of an arrow with the nock of the arrow engaging said bow string; and an elongated flexible member connected between said slide and said bow string.

2. A bow assembly according to claim 1 wherein:

said elongated flexible member comprises a cord.

3. A bow assembly according to claim 1 wherein:

said bow further includes a resilient member fixed at one end relative to said bow and connected at its other end to said slide.

4. A bow assembly according to claim 3 wherein:

said bow further includes an elongated track secured to said central bow section and extending generally transversely of said bow and said bow string; and said slide comprises an assembly including a slide member mounted for sliding movement on said track and an arrow guard member secured to said slide member.

5. A bow assembly according to claim 4 wherein:

said guard member has an upwardly opening U-shaped configuration in cross section.

6. A bow assembly according to claim 5 wherein:

said arrow receiving means comprises an arrow rest positioned within the U-shaped configuration of said guard member proximate the rear end thereof.

7. An archery bow assembly according to claim 4 wherein:

said resilient member yieldably resists said rearward movement of said slide member on said track.

8. An archery bow assembly comprising:

a bow including a central handle section and limb sections;

a bow string extending between the free ends of the limb sections rearwardly of the central handle section;

an elongated continuous track rigidly secured to said central bow section and extending generally transverse to said bow and to said bow string from a location substantially forwardly of said central bow section to a location at least as far rearwardly as said central bow section; and a slide mounted for sliding movement along said track and including means to receive the forward end of an arrow with the nock of the arrow engaging said bow string, said track having a length at least as long as the length of said slide.

9. A bow assembly according to claim 8 wherein:

said assembly further includes means biasing said slide for sliding movement along said track.

10. An overdraw assembly for use with a archery bow assembly of the type including a bow including a central handle section and limb sections and a bow string extending between the free ends of the limb sections rearwardly of the central handle section, said overdraw assembly comprising:

a slide assembly including a slide member and an arrow guard having an upwardly opening U-shaped configuration secured to said slide member;

means mounting said slide member for sliding movement on said central handle section of said bow along a path generally transverse to said handle section and to said bow string;

means on said arrow guard to receive the forward end of an arrow within the U-shaped configuration of the arrow guard with the nock of the arrow engaging said bow string; and means biasing said slide member for movement along said path.

11. An overdraw assembly according to claim 10 wherein:

said biasing means comprises resilient means fixed at one end to said mounting means and connected at its other end to said slide member.

12. An overdraw assembly according to claim 10 wherein:

said slide includes a forward end proximate said bow and a rearward end proximate said bow string; and said biasing means comprises a spring connected at its forward end to said mounting means and connected at its rearward end to said slide.

13. A archery bow assembly comprising:

a bow including a central handle section and limb sections;

a bow string extending between the free ends of the limb sections rearwardly of the central handle section;

a slide mounted for sliding movement on said central handle section of said bow along a path generally transverse to said handle section and to said bow string and including means to receive the forward end of an arrow with the nock of the arrow engaging said bow string; and resilient means extending between said bow string and said slide.

14. An archery bow assembly comprising:

a bow including a central handle section and limb sections;

a bow string extending between the free ends of the limb sections rearwardly of the central handle section;

a slide mounted for sliding movement on said central handle section of said bow along a path generally transverse to said handle section and to said bow string and including means to receive the forward end of an arrow with the nock of the arrow engaging said bow string; and means biasing said slide for movement along said path and including first resilient means fixed at one end relative to said bow and connected at its other end to said slide and second resilient means extending between said bow string and said slide.

15. An archery bow assembly comprising:

a bow including a central handle section and limb sections;

a bow string extending between the free ends of the limb sections rearwardly of the central handle section;

a slide mounted for sliding movement on said central handle section of said bow along a path generally transverse to said handle section and to said bow string and including means to receive the forward end of an arrow with the nock of the arrow engaging said bow string; and means biasing said slide for movement along said path;

said slide including a forward end proximate said bow and a rearward end proximate said bow string;

said biasing means comprising a spring fixed at its forward end relative to said bow and connected at its rearward end to said slide;

said bow further including an elongated track secured to said central bow section and extending generally transversely of said bow and said bow string;

said slide being mounted for sliding movement on said track; and said spring being secured at one end to the forward end of said track and connected at its other end to the forward end of said slide.

16. A bow assembly according to claim 15, wherein:

said bow further includes an elongated flexible member connected at its forward end to the rear end of said slide and connected at its rearward end to said bowstring.

17. A bow assembly according to claim 16 wherein:

said elongated flexible member comprises a cord.

18. A bow assembly according to claim 15 wherein:

said slide comprises an assembly including a slide member mounted slidably on said track and an arrow guard member secured to said slide member and having an upwardly opening U-shaped configuration in cross section.

19. A bow assembly according to claim 18 wherein:

said arrow receiving means comprises an arrow rest positioned within the U-shaped configuration of said guard member proximate the rear end of said guard member.

20. An archery bow assembly comprising:

a bow including a central handle portion and limb sections;

a bow string extending between the free ends of the limb sections rearwardly of the central handle section;

an elongated track rigidly secured to said central bow section and extending generally transverse to said bow and to said bow string from a location substantially forwardly of said central bow section to a location rearwardly said central bow section; and a slide mounted for sliding movement along said track and including means to receive the forward end of an arrow with the nock of the arrow engaging said bow string;

said assembly further including an elongated flexible member extending between said slide and said bow string.

21. A bow assembly according to claim 20 wherein:

said elongated flexible member comprises a cord.

22. An archery bow assembly comprising:

a bow including a central handle section and limb sections;

a bow string extending between the free ends of the limb sections rearwardly of the central handle section;

an elongated track rigidly secured to said central bow section and extending generally transverse to said bow and to said bow string from a location substantially forwardly of said central bow section to a location rearwardly said central bow section; and a slide mounted for sliding movement along said track and including means to receive the forward end of an arrow with the nock of the arrow engaging said bow string;

said assembly further including a spring secured at one end to the forward end of said track and secured at its other end to the forward end of said slide and operative to bias said slide for sliding movement along said track.

23. A bow assembly according to claim 22 wherein:

said slide comprises an assembly including a slide member mounted slidably on said track and a guard member secured to said slide member and having an upwardly opening U-shaped configuration in cross section.

24. An overdraw assembly for use with an archery bow assembly of the type including a bow including a central handle section and limb sections and a bow string extending between the free ends of the limb sections rearwardly of the central handle section, said overdraw assembly comprising:

a slide;

means mounting said slide for sliding movement on said central handle section of said bow along a path generally transverse to said handle section and to said bow string and including means to receive the forward end of an arrow with the nock of the arrow engaging said bow string;

first resilient means fixed at one end to said mounting means and connected at its other end to said slide; and second resilient means connected at one end to said slide and adapted to be connected at its other end to the bow string.

25. An overdraw assembly for use with an archery bow assembly of the type including a bow including a central handle section and limb sections and a bow string extending between the free ends of the limb sections rearwardly of the central handle section, said overdraw assembly comprising:

a slide;

means mounting said slide for sliding movement on said central handle section of said bow along a path generally transverse to said handle section and to said bow string and including means to receive the forward end of an arrow with the nock of the arrow engaging said bow string; and means biasing said slide for movement along said path;

said slide including a forward end proximate said bow and a rearward end proximate said bow string;

said biasing means comprising a spring connected at its forward end to said mounting means and connected at its rearward end to said slide;

said mounting means including an elongated track and means for securing said elongated track to the central handle section of the bow with the track extending generally transversely of the bow and the bow string;

said slide being mounted for sliding movement on said track; and said spring being secured at one end to the forward end of said track and connected at its other end to the forward end of said slide.

26. An overdraw assembly according to claim 25 wherein:

said assembly further includes an elongated flexible member connected at its forward end to the rear end of said slide and adapted to be connected at its rearward end to the bow string.

27. An overdraw assembly according to claim 26 wherein:

said elongated flexible member comprises a cord.

28. An overdraw assembly according to claim 25 wherein:

said slide comprises an assembly including a slide member mounted slidably on said track and an arrow guard member secured to said slide member and having an upwardly opening U-shaped configuration in cross section.

29. An overdraw assembly according to claim 29 wherein said arrow receiving means comprises an arrow rest positioned within the U-shaped configuration of said guard member proximate the rear end thereof.

30. An overdraw assembly for use with an archery bow assembly of the type including a bow including a central handle section and limb sections and a bow string extending between the free ends of the limb sections rearwardly of the central handle section, said overdraw assembly comprising:

an elongated track;

mounting means for mounting said elongated track rigidly to the central handle section of the bow in a position extending generally transverse to said bow and to said bow string and extending from a location substantially forwardly of the central handle section of the bow to a location rearwardly of the central handle section of the bow; and a slide mounted for sliding movement along said track and including means to receive the forward end of an arrow with the nock of the arrow engaging the bow string;

said assembly further including a spring connected at one end to the forward end of said track and connected at its other end to the forward end of said slide.

31. An overdraw assembly for use with an archery bow assembly of the type including a bow including a central handle section and limb sections and a bow string extending between the free ends of the limb sections rearwardly of the central handle section, said overdraw assembly comprising:

a slide assembly including a slide member and an arrow guard secured to said slide member;

means mounting said slide member for sliding movement on said central handle section of said bow along a path generally transverse to said handle section and to said bow string;

means on said arrow guard to receive the forward end of an arrow with the nock of the arrow engaging said bow string;

means biasing said slide member for movement along said path; and a cord connecting at one end to said slide assembly and including means at its other end to facilitate its connection to the bow string.

32. An overdraw assembly for use with an archery bow assembly of the type including a bow including a central handle section and limb sections and a bow string extending between the free ends of the limb sections rearwardly of the central handle section, said overdraw assembly comprising;

an elongated track;

mounting means for mounting said elongated track rigidly to the central handle section of the bow in a position extending generally transverse to said bow and to said bow string and extending from a location substantially forwardly of the central handle section of the bow to a location at least as far rearwardly as the central handle section of the bow;

a slide assembly mounted for sliding movement along said track and including a slide member slidably mounted on said track, an arrow guard mounted on said slide member, and an arrow rest on said arrow guard for receiving the forward end of an arrow with the nock of the arrow engaging the bow string;

resilient means connected between said track and said slide assembly and arranged to yieldably resist rearward movement of said slide assembly on said track; and a flexible member having one end connected to the rear end of said slide assembly, having another free end, and including means at its free end to facilitate connection of its free end to the bow string.

33. An overdraw assembly according to claim 32 wherein:

said flexible member is a cord.

34. An overdraw assembly according to claim 32 wherein:

said arrow guard has an upwardly opening U-shaped configuration in cross section.

35. An overdraw assembly according to claim 32 wherein:

said arrow receiving means comprises an arrow rest positioned within the U-shaped configuration of said guard member proximate the rear end thereof.

36. An archery bow assembly comprising:

a bow including a central handle section and limb sections;

a bow string extending between the free ends of the limb sections rearwardly of the central handle section;

a slide mounted sliding movement on said central handle section of said bow along a path generally transverse to said handle section and to said bow string and including means to receive the forward end of an arrow with the nock of the arrow engaging said bow string, said slide in the relaxed configuration of the bow assembly being positioned on said path with its rear end spaced forwardly from said string; and means operative in response to rearward drawing movement of said string to draw said slide along said path to a position in which the rearward end of the slide is spaced forwardly from the drawn string and the forward end of the arrow is positioned rearwardly of said central handle section; and said operative means comprises an elongated flexible member connected at its one end to said slide and at its other end to said string.

* * * * *